US007942544B2

(12) United States Patent
Smathers

(10) Patent No.: US 7,942,544 B2
(45) Date of Patent: May 17, 2011

(54) HOSE MOUNTED VISUAL INDICATING DEVICE

(76) Inventor: Randall H. Smathers, Lake Mary, FL (US)

( * ) Notice: Subject to any disclaimer, the term of this patent is extended or adjusted under 35 U.S.C. 154(b) by 169 days.

(21) Appl. No.: 12/369,092

(22) Filed: Feb. 11, 2009

(65) Prior Publication Data

US 2009/0201673 A1 Aug. 13, 2009

Related U.S. Application Data

(60) Provisional application No. 61/027,884, filed on Feb. 12, 2008.

(51) Int. Cl.
*F21L 4/00* (2006.01)

(52) U.S. Cl. ..... 362/157; 340/626

(58) Field of Classification Search ..... 362/157
See application file for complete search history.

(56) References Cited

U.S. PATENT DOCUMENTS

| | | | | |
|---|---|---|---|---|
| 4,844,000 | A | 7/1989 | Clement | |
| 5,046,456 | A * | 9/1991 | Heyman et al. | 119/859 |
| 5,539,624 | A * | 7/1996 | Dougherty | 362/556 |
| 5,623,890 | A | 4/1997 | Lenske | |
| D382,501 | S | 8/1997 | Clement | |
| 6,079,135 | A | 6/2000 | Ruiz | |
| 6,116,520 | A * | 9/2000 | Lee | 239/289 |
| 6,257,750 | B1 | 7/2001 | Strasser et al. | |
| 6,900,735 | B2 * | 5/2005 | Guerrieri et al. | 340/815.4 |
| 7,374,318 | B2 * | 5/2008 | Brooks et al. | 362/396 |
| 2004/0200536 | A1 * | 10/2004 | Strasser et al. | 138/104 |
| 2007/0063512 | A1 | 3/2007 | Tamez, Jr. | |
| 2007/0103890 | A1 * | 5/2007 | Morehead | 362/103 |
| 2008/0002400 | A1 * | 1/2008 | Huang | 362/216 |
| 2008/0294109 | A1 * | 11/2008 | Estes et al. | 604/141 |
| 2010/0002423 | A1 * | 1/2010 | Liao | 362/192 |
| 2010/0142215 | A1 * | 6/2010 | Waring | 362/473 |

* cited by examiner

*Primary Examiner* — Evan Dzierzynski
(74) *Attorney, Agent, or Firm* — Allen Dyer Doppelt Milbrath & Gilchrist

(57) ABSTRACT

A visual indicating device for mounting on a hose includes a body having an outer wall and defining a central passage extending axially through the body between a first end and a second end, and a plurality of lights arranged around the annular body so as to be visible from beyond the outer wall. A power source is arranged within the annular body, and a switch selectively energizes the plurality of lights from the power source. The visual indicating device includes groups of differing colored lights. Mounted on a hose, one of the groups indicates the general direction of the nozzle and another of the groups indicates the general direction of an exit. The switch automatically energizes the lights upon pressurization of the hose.

21 Claims, 7 Drawing Sheets

HOSE MOUNTED VISUAL INDICATING DEVICE

CROSS-REFERENCE TO RELATED APPLICATION

This application claims the benefit of U.S. Provisional Application Ser. No. 61/027,884, filed on Feb. 12, 2008, the contents of which are herein incorporated by reference in their entirety.

FIELD OF THE INVENTION

The present invention relates to hose mounted indicators, and particularly, to visual indicator devices for enhancing firefighter safety.

BACKGROUND OF THE INVENTION

Firefighting is an inherently dangerous occupation, particularly when firefighting efforts require entrance into a burning building or other enclosed structure. In addition to the flames and attendant heat, the large quantities of unvented smoke can quickly reduce visibility to inches. Under such conditions it is easy for firefighters to become disoriented. The fire hose serves as a critical lifeline for firefighters, both for its ability to combat the fire and as a guide to help firefighters reliably find their way to the fire or to safety.

Under real fire conditions, firefighters can lose hold of the fire hose, either by accident or to accomplish some other mission. To find the fire hose again in the smoke and confusion of a fire, it is often necessary for firefighters to crawl on the floor and seek out the hose with their hands. Once regained, it can be difficult, if not impossible, for the firefighter to determine which direction to follow the hose to safety outside the building, or else to the nozzle, if necessary. This difficulty is greatly increased where multiple hoses are employed and firefighters often encounter a tangled mess of hoses. Unfortunately, several tragedies have resulted when firefighters have needed to leave a building but could not, in the stress and confusion of a fire, successfully follow a hose to safety.

One example of an attempt to facilitate a firefighter's ability to follow a fire hose to safety can be found in U.S. Patent Application Publication No. 2007/00663512. In the '512 publication, a collar with tactile directional indicating shapes is fitted into hose couplings. With the heavy gloves that firefighters must typically don for safety, properly identifying tactile indicators is difficult. In one embodiment, reflective or luminescent coatings are applied on outer surfaces of the collar. However, to be effective, reflective coatings require that a firefighter have an operable flashlight, and, in conditions of extremely reduced visibility, as are common in building fires, luminescent coatings can have very limited usefulness. Moreover, many luminescent coatings require prior exposure to light for activation. Under many conditions, for instance during nighttime firefighting, adequate prior exposure may not be feasible.

Another example of an attempt to facilitate a firefighter's ability to follow a fire hose to safety can be found in U.S. Pat. No. 6,257,750. In the '750 patent, a light emitting element is provided along the exterior surface of a fire hose. The various light emitting elements of the '750 patent extend along the entire length of the hose, in the form of a strip or string woven into, or otherwise affixed to, the exterior surface. The incorporation of such strips or strings of light emitting elements requires either a specially fabricated hose, or substantial modification to the entire length of an existing hose. Subsequently, the costs of implementing the '750 patent can be prohibitively high, particularly for a fire department with a limited budget. Moreover, these costs can be expected to recur each time a hose must be replaced.

SUMMARY OF THE INVENTION

From the foregoing, it will be appreciated that there is a need for a hose mounted indicator device that provides visual indications to firefighters and others and does not require a specially fabricated, or substantially modified, hose. Accordingly, it is the object of the present invention to provide a visual indicating device that can be easily retrofitted onto an existing fire hose, and can be easily transferred to a new fire hose. It is another object of the present invention to provide a visual indicating device that can be automatically activated by pressurization of a fire hose.

According to an embodiment of the present invention, a visual indicating device for mounting on a hose includes a substantially annular body having an outer wall and defining a central passage extending axially through the body between a first end and a second end, a plurality of lights arranged around the annular body so as to be visible from beyond the outer wall, a power source arranged within the annular body, and a switch for selectively energizing the plurality of lights from the power source.

According to another embodiment of the present invention, a fire hose assembly includes at least one length of hose, and at least one visual indicating device associated with the at least one length of hose.

According to an aspect of the present invention, the at least one visual indicating device is slidably disposed over the at least one length of hose. According to another aspect of the present invention, the at least one visual indicating device is associated with a coupling on an end of the at least one length of hose.

According to a further aspect of the present invention, the hose assembly includes a plurality of lengths of hose with a nozzle arranged on a terminal end of the lengths. A plurality of visual indicating devices are associated with the lengths. Each of the visual indicating devices includes a first group of lights and second group of lights, the first group of lights being closer to the nozzle than the second group of lights.

According to a method aspect of the present invention, a plurality of visual indicating devices are connected to an existing fire hose. The fire hose is pressurized to activate the plurality of visual indicating devices.

These and other objects, aspects and advantages of the present invention will be better understood in view of the drawings and following detailed description of preferred embodiments.

DETAILED DESCRIPTION OF PREFERRED EMBODIMENTS

Figure 1:
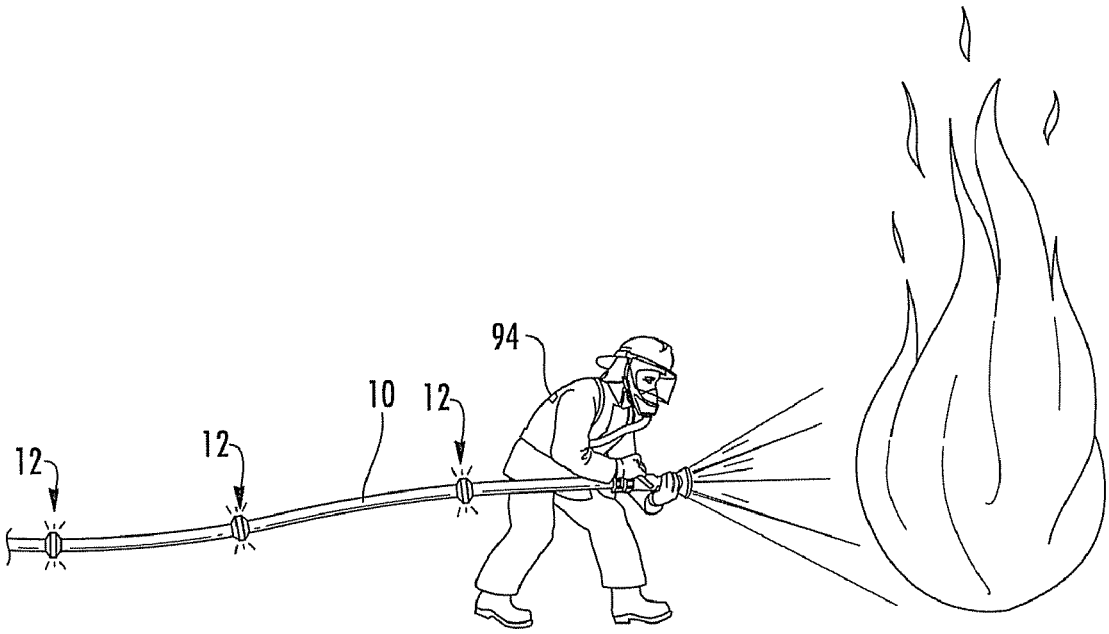
FIG. 1 is schematic view of a fire hose 10 equipped with a plurality of visual indicating devices, according to an embodiment of the present invention.
Figure 2:
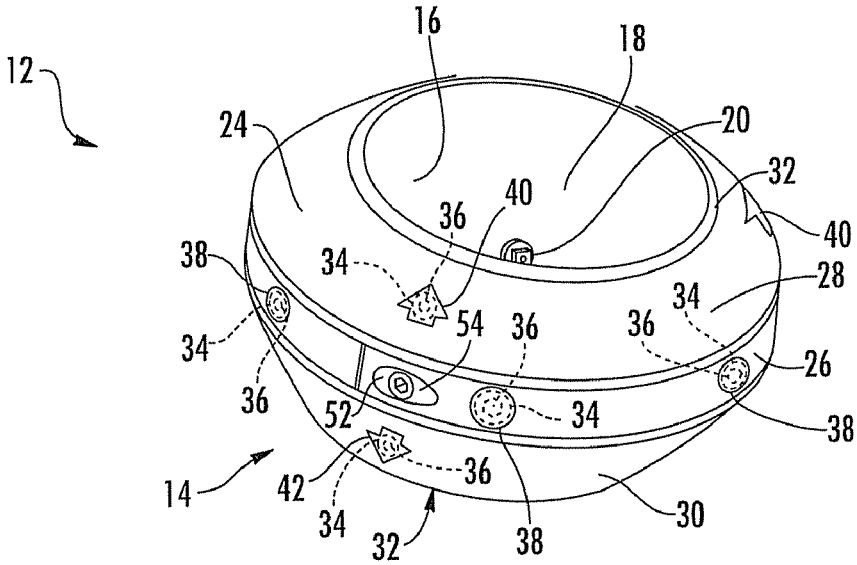
FIG. 2 is a perspective view of one of the visual indicating devices of FIG. 1, with hidden components shown in broken lines.
Figure 3:
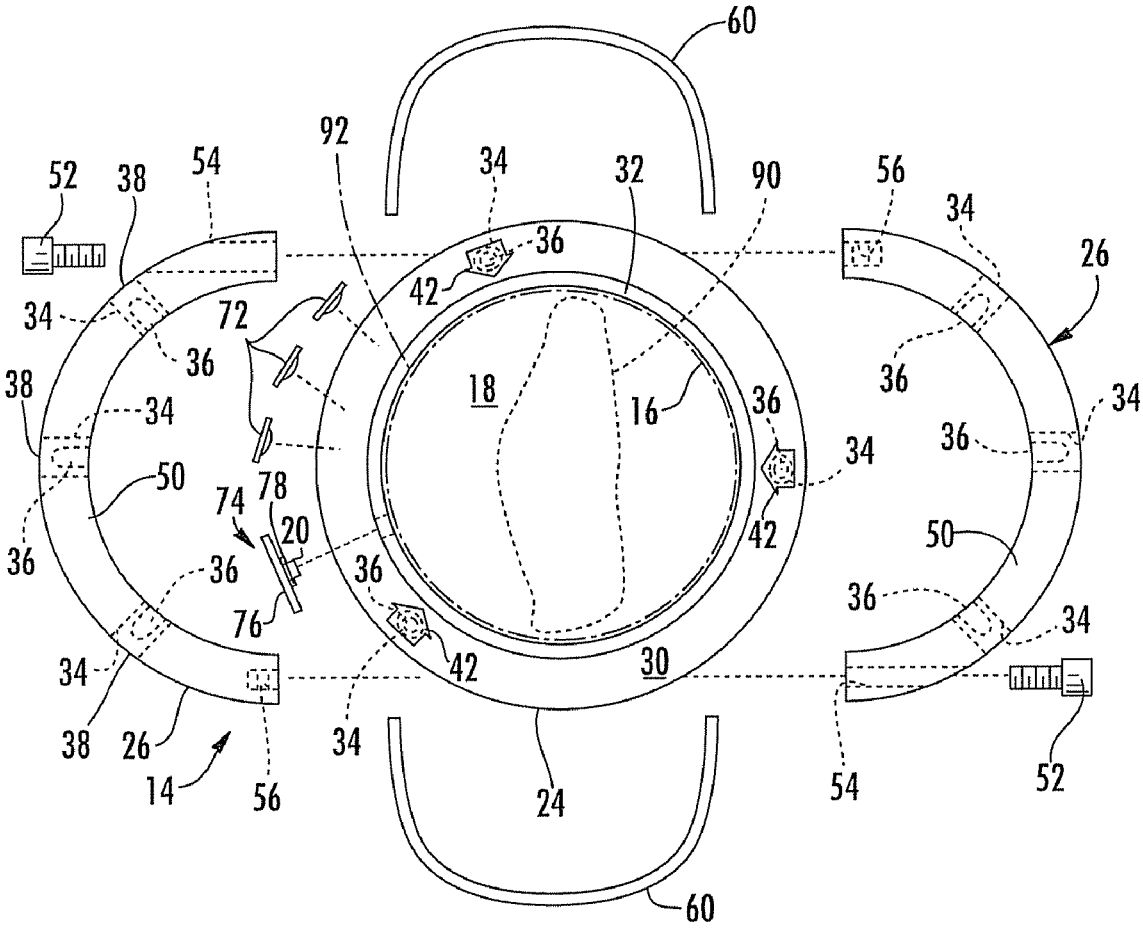
FIG. 3 is a partially exploded view of the visual indicating device of FIG. 2, with certain hidden components shown in broken lines.

Referring to FIG. 1, a fire hose 10 is equipped with a plurality of visual indicating devices 12, according to an embodiment of the present invention. The devices 12 encircle the hose 10 at regular intervals. Referring to FIGS. 2 and 3, each indicating device 12 includes an annular body 14 with an inner wall 16 defining a central passage 18 extending through the body 14. A push switch 20 extends into the central passage 18 through the inner wall 16.

The annular body 14 also has an outer wall 24 with a central portion 26, a first end portion 28 and a second end portion 30. The central portion 26 extends substantially in parallel with the inner wall 16. The first and second end portions 28, 30 slope inwards from the central portion 26 toward annular end surfaces 32. The annular end surfaces 32 are substantially perpendicular to the inner wall 16 and each end surface 32 extends between respective ends of the inner wall 16 and end portions of the outer wall 24.

A plurality of recesses 34 extend into the annular body 14 from the outer wall 24. A light emitting diode (LED) 36 is arranged in each recess 34. A clear transparent cover 38 is arranged over each of the recesses 34 and LEDs 36 in the central portion 26. A red transparent cover 40 is arranged over each of the recesses 34 and LEDs 36 in the first end portion 28. A green transparent cover 42 is arranged over each of the recesses 34 and LEDs 36 in the second end portion 30. The covers 40, 42 are arrow shaped and point away from the central portion 26 towards respective annular end surfaces 32. The covers 38-42 each form a watertight seal for their respective recesses 34.

Referring to FIG. 3, under the central portion 26 of the outer wall 24, the body 14 includes removable segments 50. The removable segments 50 are semi-circular and are secured in place in the body 14 by being secured to each other. The removable segments 50 are secured to each other by threaded fasteners 52 inserted through oblique openings 54 in the removable segments 50 and into respective threaded bores 56.

Figure 4:
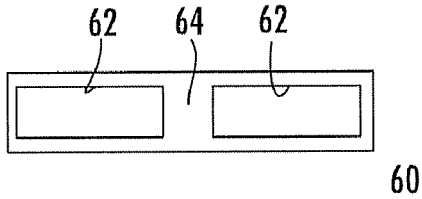
FIG. 4 is a side view of one of the components of FIG. 3.

Gaskets 60 are arranged under the removable segments 50 to form a watertight seal. Referring to FIG. 4, each gasket 60 defines open areas 62 through which electrical connections are made inside the body 14. Between open areas 62, each gasket 60 includes a solid area 64 corresponding to a junction between removable segments 50.

Figure 5:
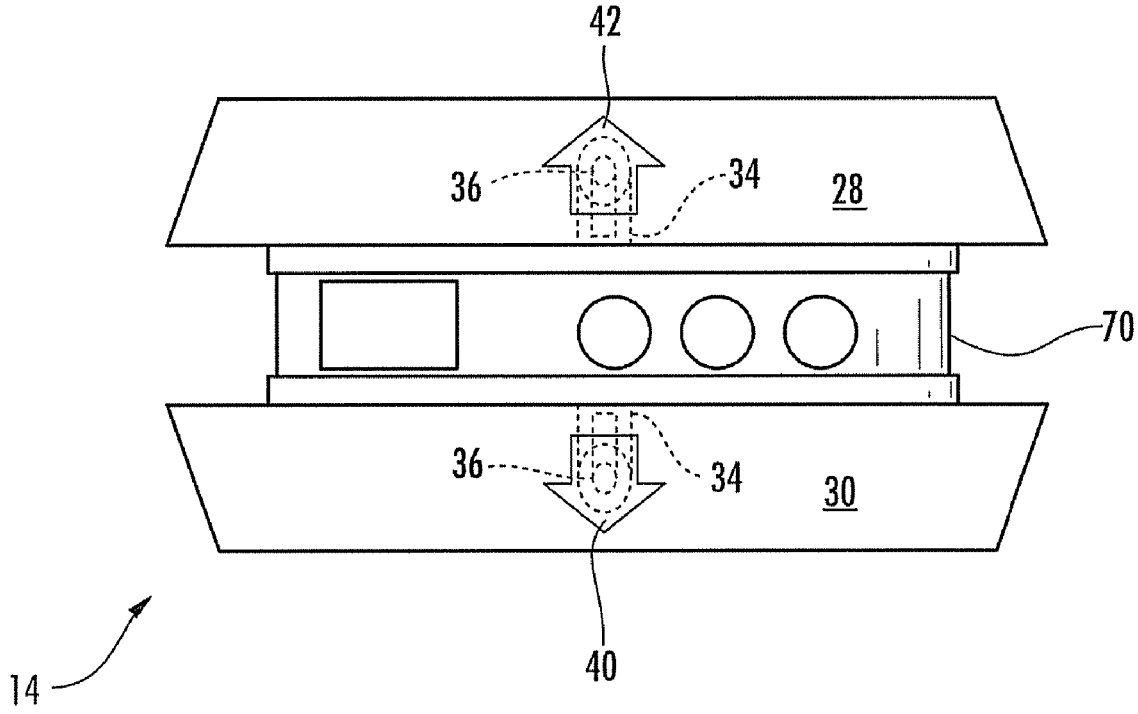
FIG. 5 is a side view of the visual indicating device of FIG. 2, with certain components removed to show details and certain hidden components shown in broken lines.

Referring to FIGS. 3 and 5, a space 70 is defined in the interior of the body 14 inside of the removable segments 50. Batteries 72 and control electronics 74 are arranged in the space 70. The recesses 34 communicate with the space 70, allowing connections to be made between the batteries 72, the control electronics 74 and the LEDs 36. The control electronics 74 are arranged on a small printed circuit board 76. The switch 20 is also connected to the printed circuit board 76. An O-ring 78 surrounds the switch 20 and forms a watertight seal where the switch 20 extends out of the inner wall 16 into the central passage 18.

Figure 6:
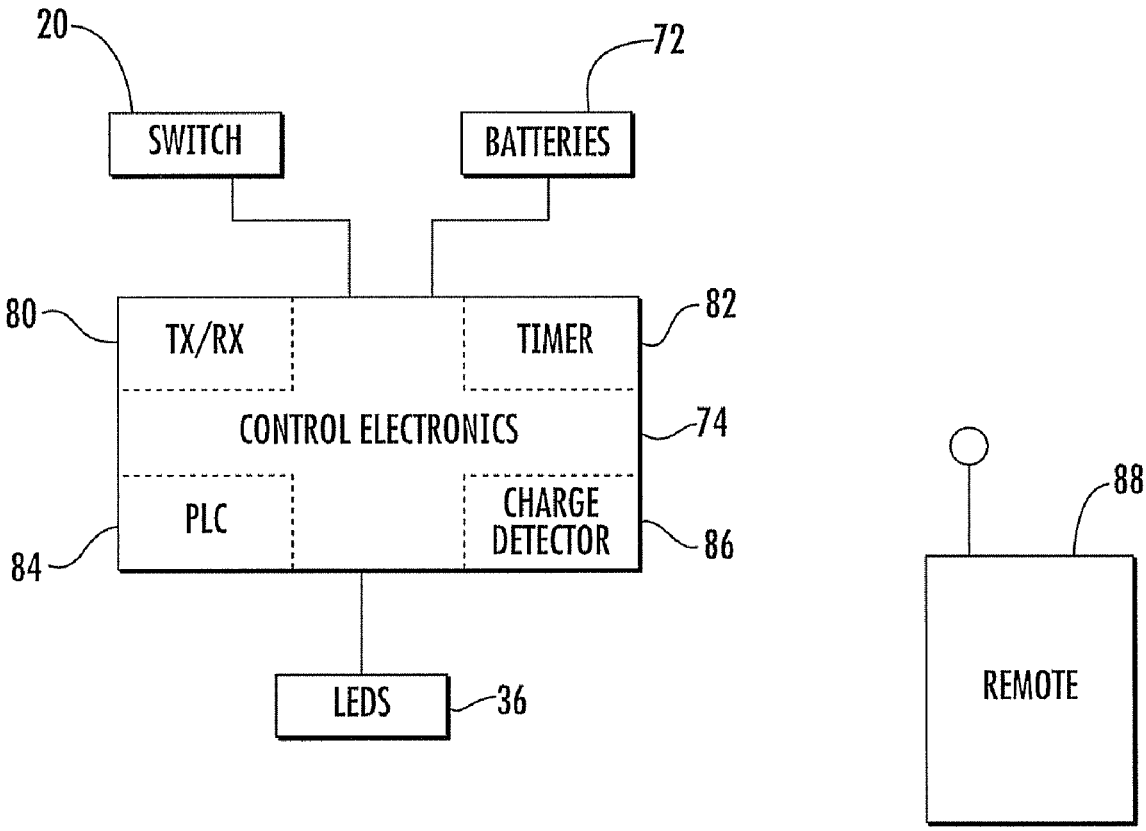
FIG. 6 is a schematic view of certain electrical and electronic components of the visual indicating device of FIG. 2.

Referring to FIG. 6, the switch 20 and the batteries 72 are electrically connected to the control electronics 74. Additionally, an alternate connection exists between the batteries 72 and the control electronics 74, allowing the switch 20 to be bypassed. The LEDs 36 are powered by the batteries 72 through the control electronics 74. The control electronics 74 include a transmitter/receiver (TX/RX) 80, a timer 82, a programmable logic controller (PLC) 84, and a battery charge detector 86. A remote device 88 can receive signals from and transmit signals to the control electronics 74.

Referring to FIGS. 1-6, in operation, a plurality of visual indicating devices 12 are arranged around the hose 10 at periodic intervals. The devices 12 are slid over the hose 10 when the hose 10 is in a depressurized state, as represented by broken line 90 in FIG. 3. Each device 12 is placed around the hose 10 so that the red covers 40 will point to the nozzle end of the hose 10, indicating the direction of the fire when the hose 10 is employed in firefighting. The green covers 42 will then indicate the direction of safety when the hose 10 is employed in firefighting. "Safety" as used herein, generally refers to the end of a hose that is opposite the end with the nozzle.

When the hose 10 is pressurized, as represented by broken line 92 in FIG. 3, the hose 10 will expand to fill the central passage 18 and press against the inner wall 16. Expansion of the hose 10 will result in depression of the switch 20, signaling the control electronics 74 to energize the LEDs 36. Alternately, the remote device 88 can be used to communicate with the TX/RX 80 to signal the control electronics 74 to energize the LEDs 36. The LEDs 36 under the clear covers 38 are preferably the brightest and facilitate initial location of the hose 10. Once the hose 10 is located, the LEDs under red and green covers 38 are used to find the nozzle of the hose 10, or to reach safety outside, respectively.

If the LEDs 36 are energized based on depression of the switch 20, upon subsequent release of the switch 20, indicating possible depressurization of the hose 10, the PLC 84 will start the timer 82. The control electronics 74 will continue to energize the LEDs 36 until the timer 82 counts to a predetermined time, ensuring the LEDs 36 are not de-energized immediately due to an inadvertent depressurization of hose 10. The predetermined time should be of sufficient duration to allow any firefighters to exit the building, and is adjustable using the PLC 84 based on the particular employment of the device 12. The PLC 84 will also direct the TX/RX 80 to communicate the possible depressurization to the remote device 88. If desired, the LEDs 36 can be de-energized at any time after hose 10 depressurization using the remote device 88.

The charge detector 86 monitors the state of charge of the batteries 72. If battery 72 charge drops below a predetermined threshold, the PLC 84 directs the TX/RX 80 to communicate with the remote device 88, indicating a low state of charge for the corresponding device 12. Additionally, during initial pressurization of the hose 10, or during a battery test routine, the PLC 84 can indicate a low state of charge for the corresponding device 12 by having the control electronics 74 flashing the LEDs 36 in a predetermined "low battery" pattern.

In addition to the predetermined pattern indicating a low battery/battery test routine, the PLC 84 is programmed with additional predetermined patterns that can be activated by communication from the remote device 88. The additional predetermined patterns include an "advance hose" pattern, a "withdraw hose" pattern, and an "evacuate" pattern. Using the remote device 88, the hose 10 equipped with devices 12 can serve as an additional channel of communication to firefighters working within a burning building.

To conserve battery 72 charge, each firefighter can be equipped with a radio-frequency identification device (RFID) device 94 recognizable by the TX/RX 80 of the control electronics 74 of each device 12 when the RFID device 94 is within a predetermined range of the device 12. When no RFID device 96 is within the predetermined range of a given device 12, the PLC 84 will operate the LEDs 36 at a reduced power level. When a RFID device 94 comes within the predetermined range, the PLC 84 will operate the LEDs 36 at a maximum power level to enhance detectability. Additionally, the PLC 84 directs the TX/RX 80 to communicate with the remote device 88 to indicate that a RFID device 94 is in the vicinity of the device 12.

The PLC 84 of each device 12 is configurable to direct the TX/RX to transmit a signal that allows the remote device 88 to identify which device 12 is the source of the transmission. In this way, the remote device 88 can identify and display information about individual devices 12. For example, when receiving communications about hose depressurization, the remote device 88 indicates which hose is depressurized. Similarly, when receiving communications about low battery charge, the remote device 88 indicates which device 12 requires fresh batteries. Likewise, when receiving communications about vicinity of RFID devices 94, the remote device 88 can be used to help determine the location of the firefighter wearing the RFID device 94.

Figure 7:
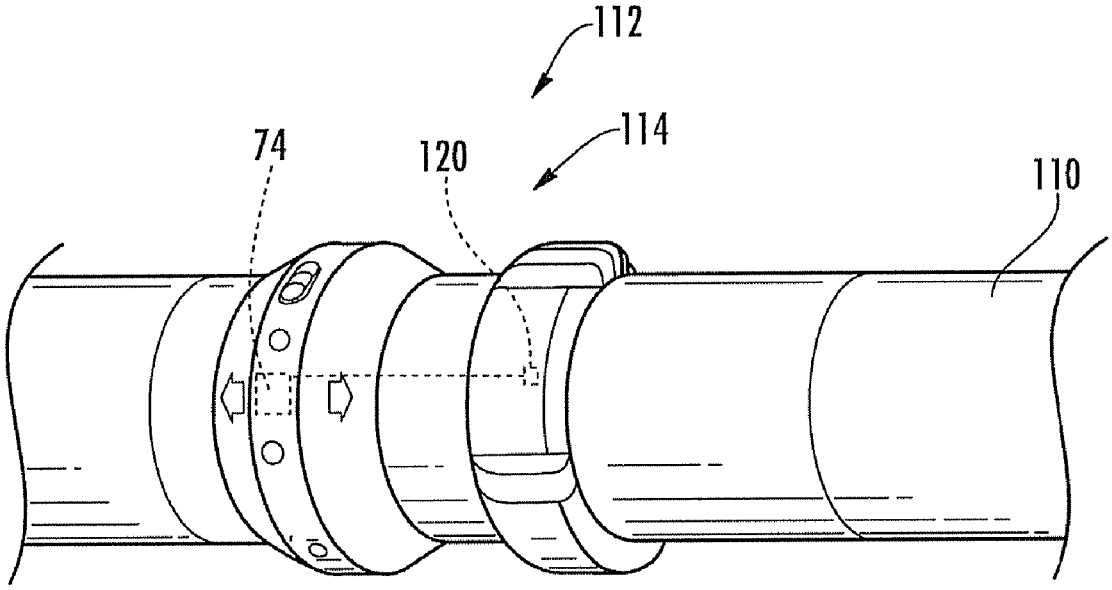
FIG. 7 is a perspective view of a visual indicating device integrated into a coupling, according to another embodiment of the present invention, with hidden components shown in broken lines.

Referring to FIG. 7, in another embodiment of the invention, a fire hose 110 is equipped with a visual indicating device 112 integrated into a hose coupling 114. The device 112 functions substantially similarly to the device 12, as described above, except that the device 112 includes a switch 120 communicating with control electronics 74, rather than the push switch 20. The switch 120 is closed when the coupling 114 is made, resulting the energization of LEDs. The control electronics 74 maintain the LEDs energized for a predetermined time after de-coupling, in a similar manner to that described above in connection with hose 10 depressurization.

Figure 8:
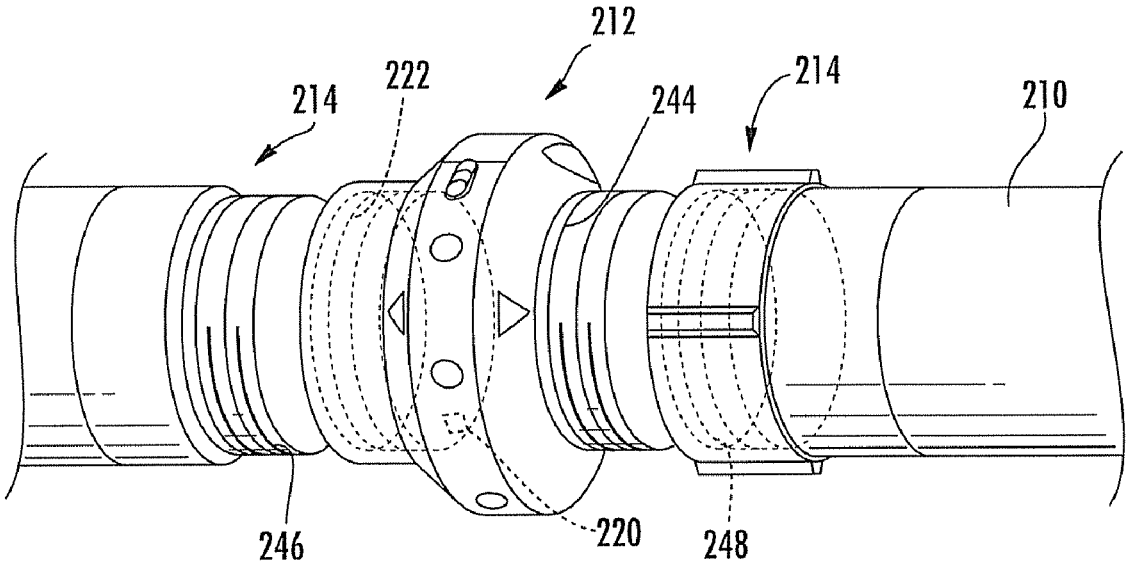
FIG. 8 is a perspective view of a visual indicating device interposed into a coupling, according to an additional embodiment of the present invention, with hidden components shown in broken lines.

Referring to FIG. 8, in an additional embodiment of the invention, a fire hose 210 is equipped with a visual indicating device 212 adapted to be interposed into hose coupling 214. The device 212 includes female and male threaded portions 222, 244 that enable the device 212 to be connected between male and female threaded portions 246, 248 of the coupling 214. The device 212 functions substantially similarly to the device 12, as described above, except that the device 212 includes a switch 220 that is closed by water pressure acting directly on the switch 220, rather than indirectly through the hose 210.

Figure 9:
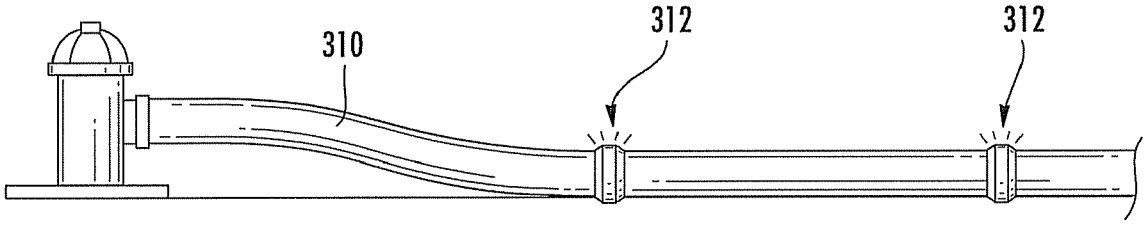
FIG. 9 is a schematic view of a feeder line equipped with a plurality of visual indicating devices, according to a further embodiment of the present invention.

Referring to FIG. 9, in a further embodiment of the invention, a feeder line 310 is equipped with a plurality of devices 312. Devices 312 are similar in construction to devices 12, 112 and 212, as described above, but are equipped with flashing red lights to warn approaching motorists of the presence of the feeder line 310 in the road. Accordingly, the risk of a motorist driving over the feeder line 310 and risking damage to feeder line 310, or inadvertent depressurization downstream of feeder line 310, is reduced.

The present invention is not limited to the embodiments shown in the drawings and described above. Rather, those skilled in the art will appreciate that numerous modifications and adaptations to particular circumstances will fall within the scope of the present invention.

For instance, while the shape of the body 14 of the device 12 has been found to be advantageous for readily accommodating the LEDs 36 in recesses on the portions 26-30, the present invention is not necessarily limited to such a shape. For example, bodies with no sloping end portions or non-annular bodies could all be employed. Also, bodies without the removable segments 50, or with different removable segments, could be employed. The body is not necessarily limited to particular dimensions, and can be adapted for any fire hose or related component design.

Also, the present invention is not necessarily limited to a particular type or design of switch 20 or 120, although these types of switches have been found advantageous. For example, contact switches, capacitance switches, magnetic switches and the like can also be employed. Likewise, combinations of switches can be employed or switches can be omitted altogether.

Additionally, the present invention is not necessarily limited to the use of LEDs as light sources, or to particular numbers or configurations of light sources. Lights or LEDs of other colors than those described herein may be employed. Covers of other shapes can also be used, such as triangles, fingers or stylized flames. Rather than colored covers, clear covers with colored LEDs can be used. Also, covers incorporating lenses for focusing the light can be used, as well as parabolic reflectors underneath the light sources. Alternately, the covers can be omitted and seals could be provided within the body 14 to provide a watertight barrier. Generally, a light adapted to display a particular color of light can include either a light that directly emits that color of light or a light that is equipped with a cover of the corresponding color.

Furthermore, seals of other designs, shapes, or types other than the seals 60 could also be employed, or the seals 60 could be omitted. For example, extremely high manufacturing tolerances could be relied on to prevent the introduction of moisture. Alternately, coated electronic components and connections could be employed to avoid short circuits even if moisture entered the body 14.

Moreover, the present invention is not necessarily limited to any particular type or sophistication of control electronics 74, or to the use of the printed circuit board 76 to hold the control electronics 74. Also, the control electronics 74 could be omitted altogether. For example, the switch 20 could directly control energization of the light sources or LEDs without control electronics. Additionally, the remote device 88 could be omitted.

Also, the present invention is not necessarily limited any particular device or means for permitting discrete identification of each device 12 by the remote device 88. For example, jumpers or dipswitches could be used to manually set a particular transmission frequency, or a particular transmission encoding, for each TX/RX 80. Alternately, each PLC 84 could be configurable to operate the TX/RX 80 so as to result in a uniquely identifiable signal.

Additionally, the present invention is not necessarily limited to the integration of a visual indicating device 112 into any particular type of coupling or other component. For example, a visual indicating device can be integrated into other coupling designs, adapters, nozzles, and the like.

The foregoing is not an exclusive list of modifications and adaptations falling within the scope of the present invention. Instead, those skilled in the art will appreciate that these and other modifications and adaptations will fall within the scope of the invention as herein shown and described, and of the appended claims.

What is claimed is:

1. A visual indicating device for mounting on a hose, the device comprising:

a substantially annular body having an outer wall and defining a central passage extending axially through the body between a first end and a second end;

a plurality of lights arranged around the annular body so as to be visible from beyond the outer wall;

a power source arranged within the annular body; and a switch for selectively energizing the plurality of lights from the power source;

wherein the switch is adapted to energize the plurality of lights upon pressurization of the hose.

2. The device of claim 1, wherein the plurality of lights includes at least a first group of lights adapted to display a first color light and a second group of lights adapted to display a second color light, the first group of lights being arranged more proximate to the first end than the second group of lights.

3. The device of claim 2, wherein the first group of lights includes a plurality of light emitting diodes that emit the first color light and the second group of lights includes a plurality of light emitting diodes that emit the second color light.

4. The device of claim 2, wherein the first and second groups of lights include a plurality of white lights, each white light of the first group arranged behind a cover of the first color and each white light of the second group arranged behind a cover of the second color.

5. The device of claim 2, wherein the plurality of lights further includes a third group of lights adapted to display a third color light.

6. The device of claim 5, wherein the first color light is green, the second color light is red and the third color light is white.

7. The device of claim 2, wherein the outer wall includes first and second end portions respectively sloping toward the first and second ends, the first group of lights being arranged around the first end portion and the second group of lights being arranged around the second end portion.

8. The device of claim 1, wherein the central passage is dimensioned to closely accommodate the hose.

9. The device of claim 1, wherein the body is integrated into a hose coupling.

10. The device of claim 1, wherein the body includes male and female coupling portions at the first and second ends for interposing the device between corresponding portions of a hose coupling.

11. The device of claim 1, wherein the device further comprises a timer associated with the switch for continuing to energize the lights for a predetermined time after a subsequent depressurization of the hose.

12. The device of claim 1, wherein the switch is remotely activatable.

13. The assembly of claim 1, wherein a portion of the switch extends into the central passage so as to be depressed by the hose upon pressurization.

14. A fire hose assembly comprising:

at least one length of hose; and at least one visual indicating device associated with the at least one length of hose, the device comprising:

a body having an outer wall and defining a central passage extending axially through the body between a first end and a second end;

a plurality of lights arranged around the body so as to be visible from beyond the outer wall;

a power source arranged within the body; and a switch for selectively energizing the plurality of lights from the power source;

wherein the switch is adapted to energize the plurality of lights upon pressurization of the hose.

15. The assembly of claim 1, wherein the at least one visual indicating device is slidably disposed over the at least one length of hose.

16. The assembly of claim 1, wherein the at least one visual indicating device is associated with a coupling on an end of the at least one length of hose.

17. The assembly of claim 16, wherein the at least one visual indicating device is integrated into the coupling.

18. The assembly of claim 16, wherein the at least one visual device is releasably connected with the coupling.

19. The assembly of claim 1, wherein the at least one length of hose is part of a feeder line.

20. The assembly of claim 1, wherein the at least one length of hose comprises a plurality of serially-connected lengths of hose, the fire hose assembly further comprises a nozzle connected at a terminal end of the lengths, and the at least one visual indicating device comprises a plurality of visual indicating devices, the plurality of lights of each of the visual indicating devices include a first group of lights and second group of lights, the first group of lights being closer to the nozzle than the second group of lights.

21. The assembly of claim 14, wherein a portion of the switch extends into the central passage so as to be depressed by the hose upon pressurization.

* * * * *